US005969307A

United States Patent [19]

Lacroix et al.

[11] Patent Number: 5,969,307

[45] Date of Patent: Oct. 19, 1999

[54] ELECTRICAL SWITCHES FOR MOUNTING IN CONTROL PANELS, ESPECIALLY FOR HEATING, VENTILATING AND/OR AIR CONDITIONING SYSTEMS FOR MOTOR VEHICLES

[75] Inventors: Louis Jean Michel Lacroix, Chaville; Henry Beraud, Vincennes, both of France

[73] Assignee: Valeo Electronics, Creteil, France

[21] Appl. No.: 09/094,850

[22] Filed: Jun. 15, 1998

[30] Foreign Application Priority Data

Jun. 20, 1997 [FR] France ..... 97 07717

[51] Int. Cl.[6] ..... H01H 19/54

[52] U.S. Cl. ..... 200/11 B; 200/11 R; 200/571

[58] Field of Search ..... 200/11 R, 14, 200/11 A–11 TW, 564, 570, 571, 336

[56] References Cited

U.S. PATENT DOCUMENTS

| | | | |
|---|---|---|---|
| 3,238,319 | 3/1966 | Godel et al. | 200/11 |
| 3,571,534 | 3/1971 | Ashman | 200/11 |
| 3,689,714 | 9/1972 | Walz | 200/11 A |
| 3,862,383 | 1/1975 | Bednarek et al. | 200/11 R |
| 4,401,862 | 8/1983 | Valentin et al. | 200/11 K |
| 4,572,931 | 2/1986 | Shiraishi et al. | 200/11 DA |
| 5,290,980 | 3/1994 | Cummings | 200/61.86 |
| 5,577,605 | 11/1996 | Dilly et al. | 200/564 |

FOREIGN PATENT DOCUMENTS

| | | | |
|---|---|---|---|
| 2 738 665 | 3/1997 | France | H01H 19/56 |
| 21 46 237 | 3/1973 | Germany | H01H 15/02 |

*Primary Examiner*—Michael Friedhofer
*Attorney, Agent, or Firm*—Morgan & Finnegan LLP

[57] ABSTRACT

A rotary electrical switch for panel mounting in a motor vehicle for control of a blower motor of a heating, ventilating and/or air conditioning installation, includes a set of conductive contact strips. These comprise coplanar primary strips and a secondary strip for power supply. The switch has a body mounted for rotation about an axis at right angles to the plane of the coplanar contact strips. The body supports a radial ring member which is bent back into two half rings with conductive radial projecting portions connected together electrically. Each projecting portion carries at its end an arm having two contact pads for making contact with the primary contact strips in two parallel planes. The projecting portions have at least one third pad for making a further contact with the secondary contact strip in one of the two planes.

28 Claims, 3 Drawing Sheets

ELECTRICAL SWITCHES FOR MOUNTING IN CONTROL PANELS, ESPECIALLY FOR HEATING, VENTILATING AND/OR AIR CONDITIONING SYSTEMS FOR MOTOR VEHICLES

FIELD OF THE INVENTION

This invention relates to electrical switches, and more particularly switches such as power switches for mounting in a control panel. The invention is concerned in particular with switches for controlling the electrical power supplied to installations in a motor vehicle for the purposes of heating, ventilating and/or air conditioning.

In particular, the invention relates to such switches comprising a body mounted for rotation about an axis at right angles to primary contact strips and a secondary, or power supply, contact strip, these contact strips constitute a set of electrically conductive elements having selected individual geometries. The body of the switch supports at least two radially extending conductive projecting portions which are interconnected electrically, carrying a total of at least three contact pads. The term "contact pad" is to be understood to mean an element for actual engagement with another conductive element, and may for example consist of a simple pressed-out projection or pipe, integral with a leaf or other conductive member.

Generally, one of the two projecting portions carries two contact pads which are arranged to make double surface contact on one of the primary contact strips, or two pads (in the form of simple surface contacts) on two adjacent contact strips.

BACKGROUND OF THE INVENTION

The above type of switch is disclosed for example in French patent specification No. 95 10566 of the Company Valeo Electronique. It is generally used for the control of an electrical apparatus such as the electric motor of a blower. The primary contact strips in the set are connected to load resistors having different values. Thus, a user can set the running mode, or speed, of the motor of the installation according to the contacts established by the switch, and in consequence according to its angular position. This setting governs the mass flow of air processed in the installation that is delivered into the cabin of the vehicle.

Because of its configuration, such a switch is of an overall size, especially in the radial direction, which is such as to confine its use to certain types of vehicles. In addition, its relatively large overall size prevents the installation from being controlled in different operating modes, of which there are at least two.

DISCUSSION OF THE INVENTION

An object of the invention is therefore to provide an electrical switch for a control panel, in which the disadvantages of known types of such switches are wholly or partly absent.

According to the invention, an electrical switch for a control panel, is provided comprising a set of electrically conductive contact strips having individual selected geometries, the set comprising a plurality of substantially coplanar primary contact strips and a secondary contact strip for power supply, together with a body which is mounted for rotation about an axis at right angles to the planes containing the primary and secondary contact strips, and which supports at least two radially projecting conductive projecting portions which are interconnected electrically and carry at least three contact pads, is characterised in that the projecting portions are so configured that two of the said contact pads out of the three establish contact in a first plane, while the third pad establishes contact in a second plane, and in that, in certain predetermined positions of the body, two of the said pads of the three are spaced apart angularly and make contact with at least one of the said primary strips, the tangential distance corresponding to the annular spacing between the said two pads being greater than the tangential distance between two adjacent contact strips and smaller than the tangential dimension of each primary contact strip, while the third pad makes contact with the secondary contact strip.

Thus the invention provides an electrical switch of the type described under "Field of the Invention" above, in which two of the three contact pads make contact in the first plane while the third pad makes contact in the second plane, which may be substantially parallel to the first plane. In addition, the said two pads, spaced apart angularly, contact at least one of the primary contact strips when the body is put in certain predetermined positions.

The expression "tangential distance", which may also be called the circumferential distance, is to be understood to mean the linear distance between two points situated on a common portion in the form of a circular arc, or two points projected on a plane and being respectively points on substantially parallel portions in the form of circular arcs.

Two configurations may be envisaged. In the first of these, the primary contact strips and the secondary contact strips are substantially coplanar, and have upper and lower faces which define the first and second planes respectively. In the other configuration, the primary contact strips and the secondary contact strip are located in two respective planes which are substantially parallel to each other, and have faces that face towards each other or which are opposed to each other, these faces defining the said first and second planes respectively.

According to a preferred feature of the invention, the primary and secondary contact strips are distributed, respectively, substantially in first and second annular zones situated at the periphery of the body of the switch. These annular zones can extend over more than 180°, or even over 360°.

In addition, when the contacts are established on coplanar primary and secondary contact strips, it is of particular advantage if the first and second annular zones are located at the periphery of the body of the switch at selected distances such that they are not in mutually overlying relationship. In that case, the radial distance between the first and second zones will preferably be chosen to be smaller than the radial distance by which the contact pads for making contacts in a common plane are separated. By contrast, where contacts are established on primary and secondary contact strips spaced apart in two superimposed planes, i.e. planes in mutually overlying relationship, the first and second annular zones may or may not be located so that one overlies the other.

Preferably, the projecting portions also carry a fourth contact pad such that a second contact can be established between the projecting portions and the secondary or power supply contact strip. In that case, it is of particular advantage to provide two projecting portions, each of which carries two contact pads.

Where two of the said projecting portions are provided, these may take numerous different forms. In particular, they may be substantially superimposed in planes parallel to the first and second planes. However, they may also be positioned in diametrically opposed relationship to each other, with each one including, at the end of its radial portion, first and second curved arms which follow a curve in a common direction around the periphery of the body of the switch; these arms are located substantially in planes parallel to the said first and second planes, the first and second arms of the opposed projecting portions preferably following curves which extend in opposite directions.

As with the projecting portions themselves, the arms comprised in the latter may be of different forms, according, firstly, depending on whether the primary and secondary contact strips on which the contacts are established are coplanar or lie in two superimposed planes, and secondly, depending on the particular forms or geometries chosen for the contact strips. Thus, the first and second curved arms of each projecting portion may follow a curve having a common constant radius of curvature or a radius of curvature which is not constant, i.e. which increases or decreases along its length. Alternatively, they may have different radii of curvature. Similarly, these arms may be of substantially identical or different lengths, such that the contact pads of one projecting element are offset angularly.

According to a further preferred feature of the invention, the arms may have a substantially axial curvature obtained by bending of the base portion of the arms, with each arm having a terminal or free end portion which is closer axially to a contact strip than is its base portion. This enables elastic contact to be obtained, through a contact point, between a contact strip and a projecting portion.

In one preferred application of the invention, the set of primary and secondary contact strips is connected to an electric motor of the installation.

According to yet another preferred feature of the invention, because of the space saved, the set of contact strips may also include, in selected locations, tertiary contact strips which form part of circuits for the control of components of the vehicle other than the electric motor of the above mentioned installation. These tertiary strips may include one or more contact strips of a lighting circuit. This particular feature is more relevant to those embodiments of the invention in which the secondary contact strip is in a different plane from the primary contact strips, because in such embodiments it is possible to provide a plurality of tertiary contact strips beside the secondary strip, above or below the primary contact strips.

In one particular embodiment in which the switch, according, to the invention controls an electric motor which governs the operating mode or speed of a blower of the installation, a mechanism may be juxtaposed to the switch, for providing a switching function for the supply of air to the blower between a so-called "fresh air" mode, in which the air is drawn from outside the vehicle, and a "recirculated air" mode in which the air is recirculated from inside the cabin of the vehicle. This double function type of switch is made possible due to the space saving obtained by the invention. In such an embodiment, it is possible to sub-divide at least one of the primary contact strips into two parts connected electrically together, in such a way that the operating mode of the motor can be controlled in the fresh air mode in the same way as in the recirculated air mode.

Preferably, the projecting portions are radial extensions of a metallic annular ring element which is bent back in such a way as to form two superimposed semicircular rings. Thus, the annular ring and its extensions can be made in a single step by stamping out from a flat disc.

Further features and advantages of the invention will appear more clearly on a reading of the following detailed description of some preferred embodiments of the invention, which are given by way of non-limiting example only and with reference to the accompanying drawings.

DESCRIPTION OF PREFERRED EMBODIMENTS OF THE INVENTION

Reference is first made to FIGS. 1 to 5, in order to describe a first embodiment of an electrical switch in accordance with the invention. This version is a so-called "monolayer" version. It consists of a rotary switch which, in the example shown in FIGS. 1 to 5, is designed to control a heating, ventilating and/or air conditioning installation for a motor vehicle (which is not shown in FIG. 1). This type of rotary electrical switch could of course be used in other types of installations.

Figure 14:
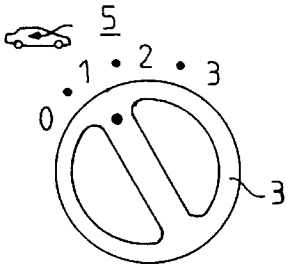
FIG. 14 shows diagrammatically the various positions which can be assumed by a switch having a set of contact strips as shown in FIG. 2.
Figure 15:
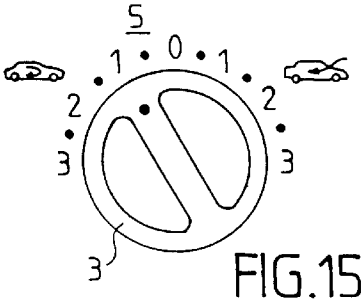
FIG. 15 shows diagrammatically the various positions which can be assumed by a switch having a set of contact strips as shown in FIG. 11 .
Figure 13:
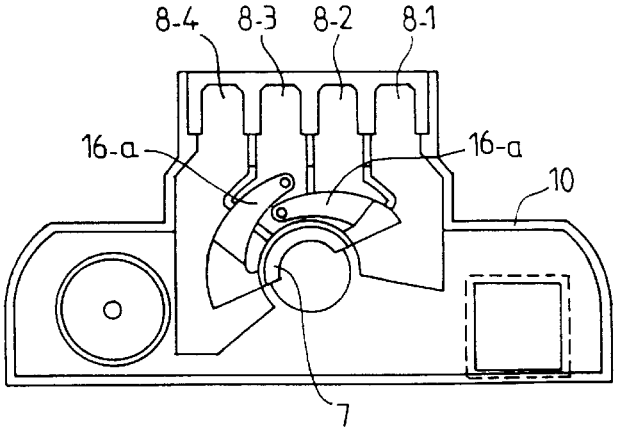
FIG. 13 shows a modified version of the lower layer of the contact strips of FIG. 8A, adapted for cooperation with the upper layer of contact strips seen in FIG. 12.

In the context of application to motor vehicles, this type of switch comprises a body 1, or barrel, which is mounted for rotation about an axis XX. The body 1 is fixed in the upper part of a control member 3 which projects out of the upper part of the control housing 4, through an aperture which is formed in the fascia 5 of the vehicle. The control member 3 is in the form of a rotary knob which is arranged to be turned by a user sitting in the cabin of the vehicle. As is shown in FIGS. 14 and 15, the rotary knob 3 is able to assume several positions which correspond to respective predetermined settings of an appropriate component part of the installation. In this example, the electrical switch is more particularly adapted to set the running mode of a blower (not shown) of the motorized blower unit of the installation.

In this connection, in the example shown in FIG. 14, the rotary knob 3 has four positions, which are indicated by the numerals 0 to 3, for example on the fascia panel 5. Each of these positions corresponds to a different setting of the blower, and consequently to a different air mass flow. In other words, each position corresponds to a current intensity in the power supply to the blower which is different from that in the next adjacent position. The position 0 indicates the rest position of the blower in which the latter is not operating, while the position 3 is the one in which the mass flow of air processed by the installation is at a maximum value.

By contrast with the rotary knob shown in FIG. 14, which only has a single function, that is to say the function of controlling only the mass flow of fresh air drawn from outside the vehicle, the rotary knob 3 shown in FIG. 15 has two functions. These are the functions of controlling the mass flow of fresh air drawn from outside the vehicle and that of controlling the mass flow of air drawn from inside the cabin (usually referred to as recirculated air). In this example, the control knob, and therefore the electrical switch, is able to assume seven different positions, of which a central position corresponds to putting the blower out of operation, while two sets of three lateral positions each correspond to three different blower speeds. In FIG. 15, the left hand set of these lateral positions 1 to 3 controls the flow of recirculated air, while the right hand set of lateral positions (again denoted 1 to 3) controls the flow of fresh air from outside.

The body 1 of the rotary switch also supports, in a lower part 6 of the body (see FIG. 1), a cursor 7 (or contactor), which is made of an electrically conductive material. The cursor 7 is arranged to make electrical contact between primary contact strips 8-*i* and a secondary, or power supply, contact strip 9, the contact strips 8 and 9 together constituting a set of contact strips. In the embodiment shown in FIGS. 1 to 5, i=1 to 4, so that the primary strips 8-1 to 8-4 constitute the set of contact strips with the secondary or power supply strip 9, which in this embodiment is coplanar with the strips 8. All of these contact strips are made of an electrically conductive material, which, may, for example be copper. As can best be seen best in FIGS. 2 and 5, the strips are held side by side in a support member 10, which is made of an insulating material such as a synthetic plastics material.

In this example, the primary and secondary contact strips 8 and 9 respectively are spaced apart over an angular sector of about 180°. However, they can be arranged to extend over an angle of greater than 180°, or even over 360°, as may be convenient. The secondary or power supply strip 9 has a central portion 11 which is partly annular in form and which is arranged to surround the body 1 at a peripheral distance R1 from the axis XX. The strip 9 terminates at one end in a tag 12 for connection to a suitable electrical connector, not shown in the drawings.

The primary contact strips 8-*i* are located beyond the secondary or power supply strip 9, at a peripheral distance R2 from the axis XX, where R2 is greater than R1. Each of these strips 9 comprises a partially annular first portion which terminates, as with the secondary or power supply strip 9, in a second portion which constitutes a tag 13 for insertion into the above mentioned connector. The above mentioned first portions of the strips 8 accordingly lie within a second annular zone which, in this example, surrounds the first annular zone 11.

The above mentioned connector leads to a current or voltage generator, to connect the power supply contact strip 9 to this generator. The primary contact strips 8 are independent, and electrically insulated, from each other. Each of these strips 8-1 to 8-4 is connected, via the connector, in which they are inserted, to a respective one of a set of resistors (not shown). These resistors are of different values and form an integral part of the power supply circuit for the electric motor of the blower. Thus, the intensity of the current with which the electric motor of the blower is supplied depends on the selection of the particular primary contact strip 8 which is contacted by the cursor 7 at the same time as the secondary strip 9.

Figure 3:
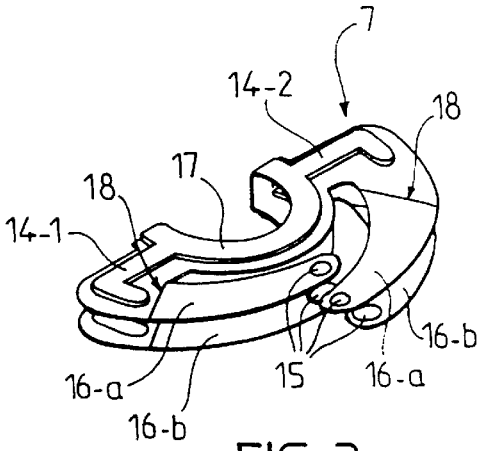
FIG. 3 is a simplified isometric view showing a cursor or "contactor" of a switch in accordance with the invention, in a version which is matched to the form of the contact strips shown in FIG. 2.
Figure 4:
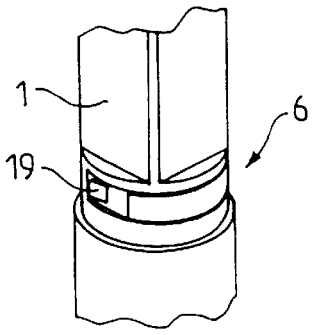
FIG. 4 is an isometric scrap view showing the part of the body of the switch which is adapted to support the cursor seen in FIG. 3.
Figure 5:
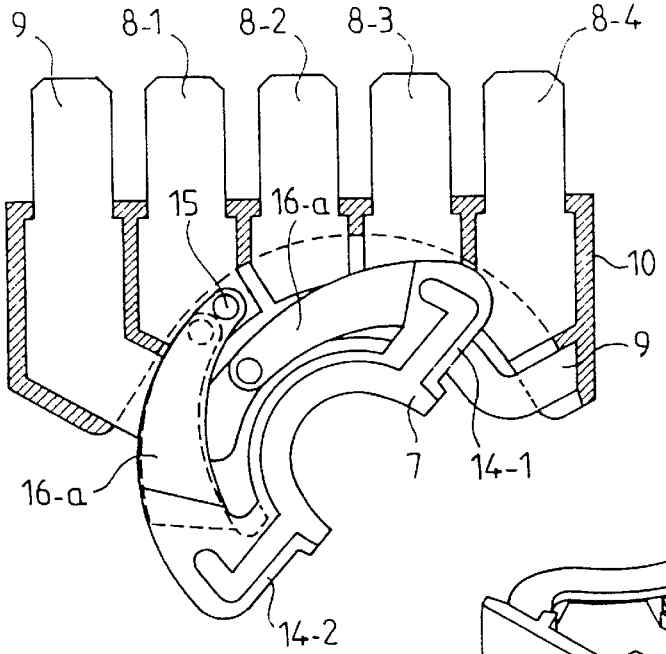
FIG. 5 is a top plan view showing the set of contact strips from FIG. 2, together with the cursor of FIG. 3.

In order to make this contact, the cursor 7, as shown in particular in FIGS. 3 and 5, includes projecting portions 14-1 and 14-2, each of which consists of a substantially radial linear portion which is extended, in the example shown, by two arms 16-*a* and 16-*b* of generally circular form. Each of these arms 16 carries at its free end a contact pad 15 (here in the form of a press-formed pipe for making electrical contact between the projecting portion 14 that carries it and the particular contact strip 8 which is currently being contacted. In the example shown, each of the arms 16 follows a curve around an annular portion 17 of the cursor 7 which joins the two projecting portions 14 electrically together.

In a preferred method of making the cursor 7, the latter is first stamped out from a blank in the form of a flat disc, which is preferably of metal, so as to form the circular (or more strictly arcuate) portion 17, and the projecting portions 14 with their arms 16. The cursor 7 is then reformed by bending along a diameter of the annular portion, in such a way that the arms 16 of the projecting portions 14 are put into two planes substantially parallel to each other. These planes are here referred to as the upper plane (for the arm 16-*a*) and the lower plane (for the arm 16-*b*). Preferably, the contact pads 15 are embossed in the free end portions of the arms 16 using an appropriate tool. Such embossing may be carried out after the step of stamping out the cursor 7, but before the bending operation mentioned above.

In this example, in order to reduce overall size to a minimum, the two projecting portions 14 of a pair (i.e. their base or radial portions) are substantially diametrically opposed, and their pairs of arms 16 extend in two opposed directions after the bending operation, the arm 16-*a* in the clockwise and the arm 16-*b* in the anticlockwise direction as seen in FIG. 5. In consequence, the contact pads 15 are all grouped together in a region of small volume.

Because of the four contact pads, which in this example are carried by four arms as described above, it is possible, when the body 1 is in one of its predetermined positions, to make double electrical contacts simultaneously on the secondary or power supply contact strip 9 and on the particular primary contact strip 8 which is associated with the prevailing setting of the control knob 3.

In this example, the two first projecting portions 14-1 are arranged (as shown in FIG. 5) to make double contact with the central portion 11 of the power supply contact strip 9, which is closer to the axis XX than are the primary strips 8. This is why, in this example, the arms 16-*a* and 16-*b* carried by the first projecting portion 14-1 are of substantially identical dimensions, as to both length and curvature, so that their corresponding arms 16-*a* and 16-*b* extend in this example over an angular sector of about 90°, and the contact pads 15 of these two arms therefore substantially face towards each other (see FIG. 3).

In order to enable elastic contact to be obtained, the four arms 16-*a* and 16-*b* have an axial curvature which is obtained, after the initial stamping out step, by bending the base portion 18 situated at the end of the linear part of the corresponding projecting portion 14.

When the set of contact strips, and more precisely the secondary strip 9, is introduced between the two arms 16-*a* and 16-*b* of the first projecting portion 14-1, their contact pads 15 then make electrical contact with the upper and lower faces of the strip 9, which is therefore interposed between these contact pads.

In order to reduce to a minimum the radial overall dimension of the cursor 7, the arms 16-*a* and 16-*b* of the first projecting portion 14-1 are tapered, their radius of curvature decreasing from the base portion 18 towards the opposed terminal portion carrying the corresponding contact pad 15.

The two arms 16-*a* and 16-*b* carried by the second projecting portion 14-2 are made in the same way as are those carried by the first projecting portion 14-1. In this example, they are however of unequal lengths. The contact pads 15 carried by these two arms 16-*a* and 16-*b* are therefore not superimposed directly one above the other. They are offset axially by a distance which is greater than the circumferential (or tangential) distance which separates two adjacent contact strips (i.e. primary contact strips or primary and secondary contact strips), this distance being smaller than the circumferential extension of the primary contact strips 8 into the second annular zone of the secondary contact strip 9 mentioned above.

Thus, the arms 16-*a* and 16-*b* of the second projecting portion 14-2 are able to establish, either a double contact on the upper and lower faces of one of the primary contact strips 8, or two single contacts on the upper face of one contact strip and the lower face of the next adjacent contact strip, so as to short circuit them without interrupting the power supply to the motor. In this short-circuit situation, the switch is between two of its predetermined settings, but an electric current continues to flow. This prevents arcing, while ensuring continuity of the power supply to the motor through point contact.

Figure 1:
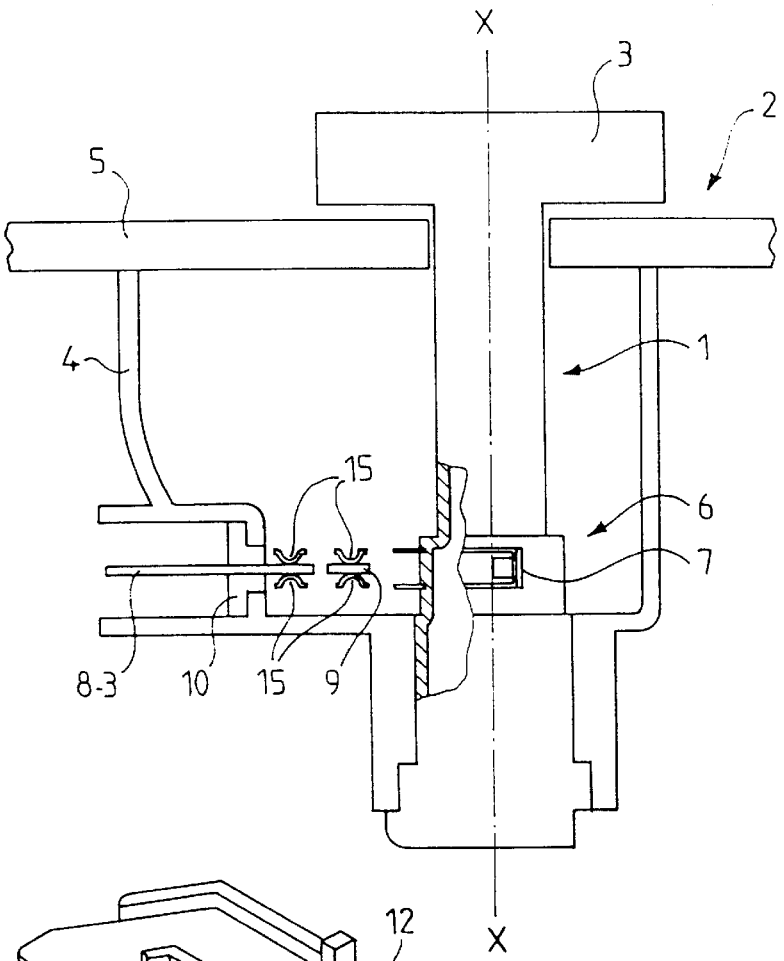
FIG. 1 is a diagrammatic representation showing a switch according to the invention, in a first embodiment which is a so-called "monolayer" version, FIG. 1 being a partially exploded view in partial transverse cross section.
Figure 2:
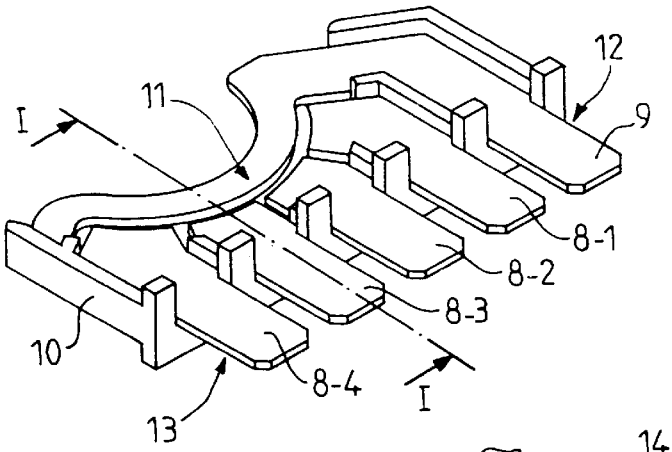
FIG. 2 is a simplified isometric view showing a set of contact strips in accordance with the invention, adapted for use in a switch of the same type as that shown in FIG. 1.

In the version of the contact strip assembly shown in FIG. 2, in order that the switch shall be in a rest position (or "off" position), it is necessary that the four contact pads carried by the two projecting portions 14-1 and 14-2 should all be in contact with the secondary or power supply contact strip 9. There is then no primary contact strip 8 in electrical connection with the power supply strip 9, and consequently the electric motor is not supplied with any current. On the other hand, in order that the motor shall be supplied with power at a predetermined current intensity, it is necessary that the two contact pads 15 carried by the two arms 16 of the first projecting portion 14-1 should be in contact with the secondary or power supply contact strip 9. It is also necessary that the two contact pads 15 carried by the two arms 16 of the second projecting portion 14-2 should be in contact with the upper and lower faces of one of the primary strips 8.

Thus, in order to enable the switch to be put in its off position, the four contact pads 15 carried by the two projecting portions 14 must be close to each other. This is why, in this example, each of the arms 16-*a* and 16-*b* carried by the second projecting portion 14-2 extends over an annular sector in the region of 90°. In addition, in order that the arms 16 of the second projecting portion 14-2 can follow a curve around the arms 16 carried by the first projecting portion 14-1, their respective radii of curvature increase from the base portion 18 of the arm concerned towards its terminal portion that carries the corresponding contact pad 15.

When the set of contact strips is introduced between the upper and lower levels (planes) containing the arms 16, the arms 16-*a* and 16-*b* of the second projecting portion 14-2 can make contact with the upper and lower faces, respectively, of the primary strips 8, which are now interposed between the respective contact pads.

It will of course be understood that the respective forms of the arms carried by the projecting portions 14 are dependent on the form selected for each of the contact strips in the set. The same is true for the positioning of the radial or base portions of the projecting portions 14, which are not necessarily located in diametrically opposed relationship. Thus, two of these radial portions could be arranged so that they are superimposed one above the other, carrying, in locations which may or may not be radially spaced apart, two arms 16, with each of the latter arranged to make contact with the upper or lower faces of the secondary or power supply contact strip 9 and the primary contact strips 8.

Similarly, in the case where projecting portions are diametrically opposed to each other, a modified version can be envisaged in which the arms 16-*a*, contained substantially in the above mentioned upper plane, are so configured as to contact the single secondary or power supply contact strip 9; while the arms 16-*b*, which are contained substantially within the lower plane, are so configured as to make contact only with the primary strips 8 (outside the off position). Numerous other modifications can of course be envisaged.

The cursor 7 is secured against movement on the body 1 in the lower part 6 of the latter, by an immobilising means of the type consisting of at least one projecting lug 19 (shown in FIG. 4), which is adapted to cooperate with a corresponding notch formed on the cursor 7, for example in the radial portions of its projecting portions 14-1 and 14-2.

Figure 6:
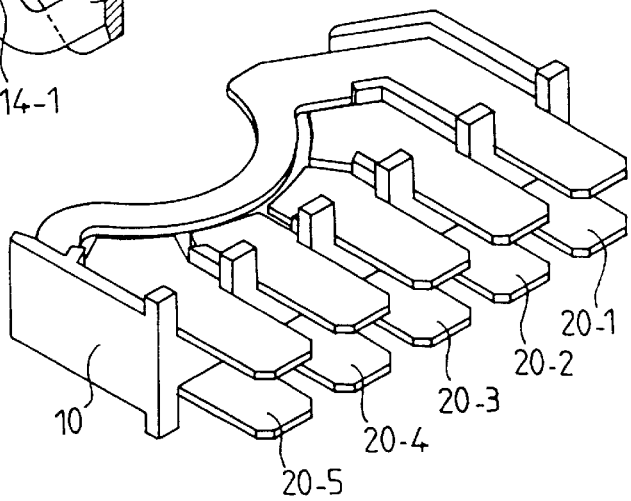
FIG. 6 is a view similar to FIG. 2, but shows another version of the contact strips.
Figure 7:
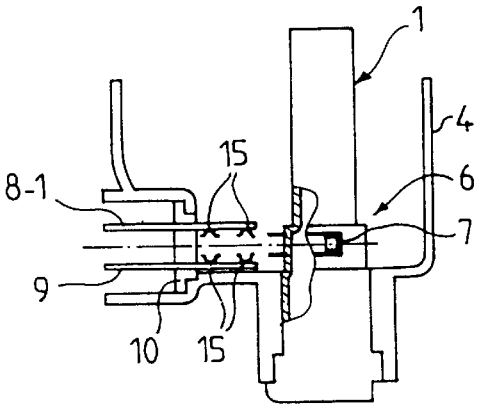
FIG. 7 is a simplified diagrammatic view showing part of a switch in accordance with the invention in a second embodiment which is a so-called bilayer version, FIG. 7 being a partly exploded view shown in partial transverse cross section.

Because of its particular form of construction, a switch such as that described above, in accordance with the invention, may also incorporate tertiary contact strips which form part of electrical power supply circuits for other systems in the vehicle, for example the lighting system. Reference is now made to FIG. 6, showing a modified form of the contact strip assembly in such a modification, which includes tertiary contact strips 20-1 to 20-5. In this example, the tertiary strips 20 are retained by the support member 10 in a plane which is substantially parallel to those of the primary strips 8 and secondary strip 9.

The assembly shown in FIG. 6 is an example of a twin-layer, or bi-layer, arrangement. Reference is now made to FIGS. 7 to 13, in order to describe a second embodiment of the invention which is a bi-layer version. In this second embodiment, with a view to reducing radial overall size, the secondary or power supply contact strip 9 is no longer located in the same plane as the primary contact strips 8. As can be seen in particular from FIG. 8A, the secondary or power supply contact strip 9 is now located below the primary contact strips 8. It may equally well be above the strips 8. These two types of contact strips are consequently held by the support member 10 with some strips side by side, but with one strip above or below the others, giving the bi-layer configuration. By contrast with the first embodiment described above with reference to FIGS. 1 to 5, in this second embodiment as showin in FIG. 8B, the annular portions of the primary contact strips 8 and the secondary or power supply strip 9 are in overlying relationship one with the other. However, although this is preferable, it is not necessarily the case in modified versions of this embodiment.

Thus, with the aid of the contact pads 15 carried by the arms 16-*a* of the two projecting portions 14-1 and 14-2, which are substantially contained in one of the two planes mentioned above (in the example shown the upper plane), only the primary contact strips 8 are contacted, while, with the contact pads 15 carried by the arms 16-*b* that are contained substantially in the lower plane, only the secondary contact strip 9 is contacted.

Figure 8B:
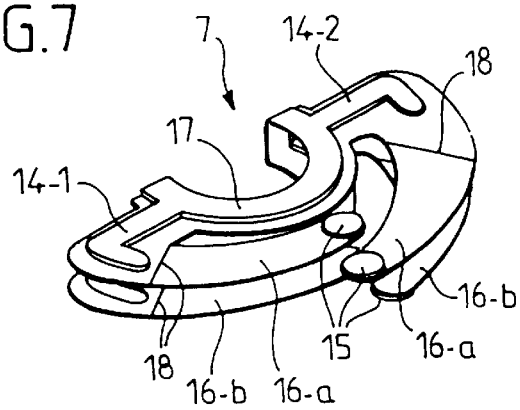
FIG. 8B is an isometric view showing a contactor in accordance with the invention in an embodiment which is matched to the form of the contact strips seen in FIG. 8A.

In this second embodiment, two alternative possibilities may be envisaged, in accordance with which the arms 16-*a* and 16-*b* of the radial projecting portions 14 are located between the primary contact strips 8 and the secondary contact strip 9, on the one hand, or, on the other hand, these arms flank the primary contact strips and the secondary contact strip. It will be quite clear that the direction of the axial curvature of an arm, and the particular face of the contact strip on which the corresponding contact pad carried by that arm is formed, will depend on the version selected, in order that the contact pads 15 which they carry respectively will be able to make effective elastic contact with the upper or lower faces of the contact strips of the set. FIG. 8B shows one example of a cursor which is adapted to make contacts, in an interleaved position, with the set of contact strips of FIG. 8A.

In this second embodiment, in order to obtain the rest position or off position of the blower, which corresponds to a situation in which all four contact pads 15 are connected to the secondary or power supply contact strip 9, it is advantageous if one of the contact strips, for example that indicated by the reference numeral 8-1, is connected electrically to the power supply strip 9, with the other primary strips 8-2 to 8-4 remaining independent from the power supply strip, whereby to offer three different settings.

Figure 12:
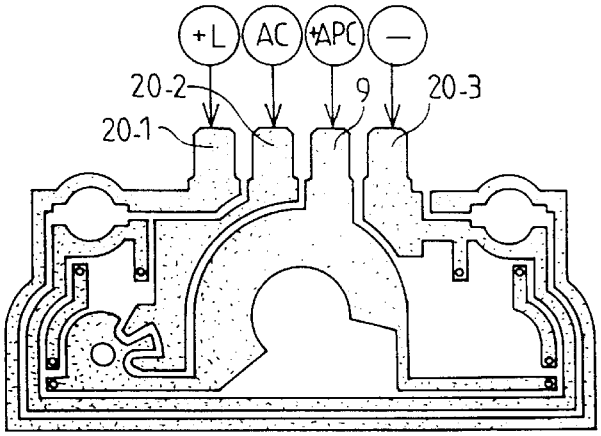
FIG. 12 shows a second modified version of the upper layer of the contact strips in FIG. 8A.

In the same way as is shown in FIG. 6 described above, this second embodiment enables the tertiary contact strips 20 to be incorporated in the switch. The tertiary contact strips may be located in the same plane that contains the power supply strip 9, and this arrangement is shown in FIG. 12, to which reference is made. However, the tertiary strips can equally well be located in the same plane as the primary strips 8.

It will be clear that the support member 10 for the various contact strips will be designed to carry the particular number of primary, secondary and tertiary contact strips which are provided, and also being matched to their particular shapes.

As in the first embodiment above, the forms taken by the arms 16 can vary in accordance with the forms of the primary contact strips 8 and secondary contact strip 9.

Figure 8A:
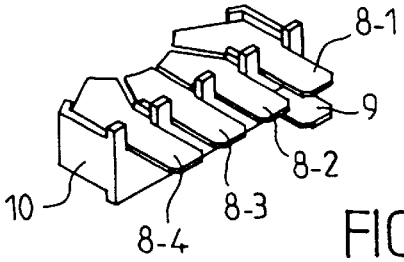
FIG. 8A is an isometric view showing a set of contact strips according to the invention adapted for use in a switch of the same type as that shown in FIG. 7.
Figure 9:
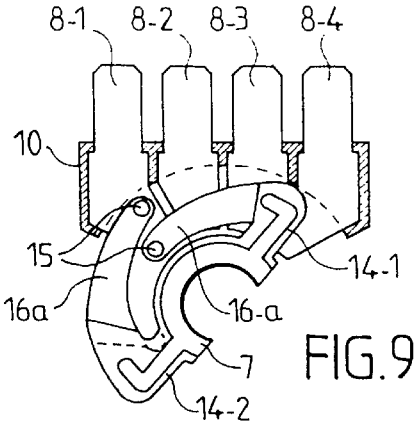
FIG. 9 is an inverted plan view showing the upper layer of the set of contact strips in FIG. 8A and the upper part of the contactor seen in FIG. 8B.
Figure 10:
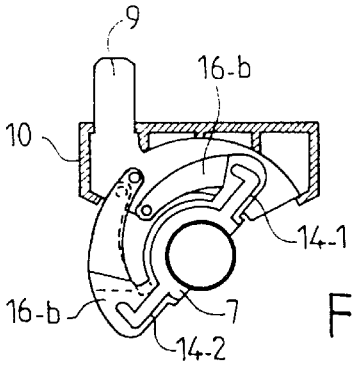
FIG. 10 is a top plan view showing the lower layer of the set of contact strips of FIG. 8A and the lower part of the contactor of FIG. 8B.
Figure 11:
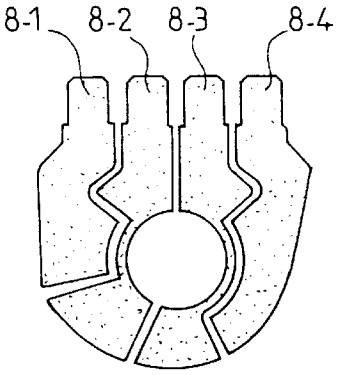
FIG. 11 shows a first modified version of the upper layer of the set of contact strips in FIG. 8A.

The set of contact strips shown in FIG. 8A is more particularly adapted for a single function, such as for example that of control of the mass flow of fresh air drawn from outside and delivered by the blower. In order to use the switch of the invention in a double function mode, as illustrated in FIG. 15 described earlier herein, it is necessary to adapt the primary contact strips 8 of FIG. 8A. FIG. 11 shows one example of strips 8 adapted in this way. The strips 8 are now distributed over substantially 360°. The strip 8-1 corresponds substantially to the off position 0 shown in FIG. 15, while the strips 8-2 to 8-4 correspond, respectively, to positions 1 to 3 for each of the two functions (delivery of recirculated air and delivery of fresh air) represented in FIG. 15. To this end, each of the strips 8-2 to 8-4 comprises two portions which are connected together electrically in such a way that contact through one or other portion of a contact strip ensures that the electric motor will be supplied with current at the same current intensity.

Preferably, in order to permit switching from one function to the other, for example by changing from processing of recirculated air to processing of fresh air, the body of the switch is coupled mechanically to a cam track which governs the position of one or more air inlet valves.

The invention is not limited to the embodiments described above, but it embraces all of the versions that could be developed by a person familiar with this technical field within the scope of the claims of this application. Thus for example, a cursor has been described above which carries four contact pads, but it will be clear that the cursor may have only three contact pads, provided that two of the latter are arranged to make double contact on the primary contact strips in predetermined positions of the switch, while the third pad makes contact with the secondary or power supply contact strip.

In addition, embodiments have been described in which, due to the arrangement of the primary contact strips and the secondary contact strip, the contact pads are all grouped in the same region. It will however be clear that versions can be envisaged in which the contact pads are remote from each other.

What is claimed is:

1. An electrical switch for panel mounting, comprising:

a set of electrically conductive contact strips comprising a plurality of primary contact strips and a secondary contact strip for power supply;

a body carrying at least two conductive and electrically interconnected projecting elements, the projecting elements carrying at least three contact pads, the primary contact strips being substantially coplanar and the body being rotatable about an axis perpendicular to said plane;

each of said projecting elements comprising a portion projecting radially from the body with respect to the axis;

the set of contact strips defining, between two adjacent primary contact strips, a first tangential distance, each of said primary contact strips having a tangential dimension;

wherein in certain predetermined rotational positions of the body, two of the three contact pads define an angular space between them and contact at least one of said primary contact strips, the angular space defining a second tangential distance greater than the first tangential distance and smaller than the tangential dimension of each of the primary contact strips, the other of said contact pads contacting the secondary contact strip.

2. A switch according to claim 1, wherein the first and second primary contact strips are substantially coplanar with each other.

3. A switch according to claim 1, defining a plane containing a secondary contact strip being substantially parallel to the plane containing the primary contact strips.

4. A switch according to claim 3, further being combined with an electric motor, wherein the primary and secondary contact strips are connected to the motor, the set of contact strips further including, in selected locations, tertiary contact strips for constituting parts of control circuits for components other than the motor, and wherein the tertiary contact strips are coplanar with the secondary contact strip.

5. A switch according to claim 1, having two said projecting elements, at least one of said projecting elements carrying two of said at least three contact pads.

6. A switch according to claim 1, wherein one of said projecting elements carries a supplemental contact pad in addition to the at least three contact pads for establishing a second contact with the secondary contact strip.

7. A switch according to claim 6, wherein each of the projecting elements carries two contact pads from a set of contact pads comprising the at least three contact pads and the supplemental contact pad.

8. A switch according to claim 7, wherein the two projecting elements diametrically oppose each other, each of the two projecting elements comprising a radial portion, a first arm and a second arm, the first arm and the second arm of each projecting element extending from the radial portion of the projecting element, the first and second arms of each projecting element being curved in a common direction about a periphery of the body of the switch, the arms lying substantially in planes parallel to the plane of the primary contact strips.

9. A switch according to claim 8, wherein the first arms lie in respective planes different from each other and substantially parallel to the plane containing the primary contact strips, the second arms lying in respective different planes substantially parallel to the plane containing the primary contact strips.

10. A switch according to claim 8, wherein the first and second arms of the opposed projecting elements are curved in opposite directions.

11. A switch according to claim 10, wherein the first arms have a first radius of curvature, the second arms have a second radius of curvature, and the first radius of curvature is the same and the second radius of curvature.

12. A switch according to claim 11, wherein each of said first arms comprises a base portion and a terminal portion extending from the base portion, each of the first and second arms of a first one of the projecting elements having a width, the width decreasing from the base portion to the terminal portion, the first radius of curvature and the second radius of curvature of the second projecting element increasing from the base portion towards the terminal portion, and each of said terminal portions having at least one of said contact pads.

13. A switch according to claim 11, wherein each of said first arms defines a radius of curvature, the radius of curvature being constant.

14. A switch according to claim 11, wherein each of said first arms defines a radius of curvature and has a length the radius of curvature being variable along the length of each first arm.

15. A switch according to claim 10, wherein each of said arms comprises a base portion and a terminal portion joined to the base portion, the terminal portion including at least one of said contact pads, each of said first arms having a radius of curvature increasing from the base portion towards the terminal portion, and each of said second arms having a radius of curvature decreasing from the base portion towards the terminal portion.

16. A switch according to claim 10, wherein the first and second arms are of substantially identical lengths.

17. A switch according to claim 10, wherein at least one of the projecting elements has arms of different lengths wherein the contact pads of the first arm and second arm, respectively, are offset angularly.

18. A switch according to claim 10, wherein each of said arms has a base portion and a terminal portion joined to the base portion, the base portion being bent to define a substantially axial curvature, each of said arms defining a first axial distance between the terminal portion and one of the primary contact strips and defining a second axial distance between the base portion and the same primary contact strip, the first distance being smaller than the second distance for providing elastic contact between one of the contact strips including a contact point and one of the projecting portions through the contact point.

19. A switch according to claim 6, wherein two of said projecting elements lie at least partially in planes parallel to the plane containing the primary contact strips.

20. A switch according to claim 1, further defining first and second annular zones situated at a periphery of the body, the primary and secondary contact strips being located substantially in the first and second zones, respectively.

21. A switch according to claim 20, wherein the first and second annular zones are situated at the periphery of the body at distances such that there is no overlying relationship between said zones.

22. A switch according to claim 21, defining a radial distance between the first and second zones smaller than the radial distance separating the contact pads for establishing contacts in a common plane.

23. A switch according to claim 1, further being combined with an electric motor, wherein the primary and secondary contact strips are connected to the motor.

24. A switch according to claim 23, wherein the set of contact strips further includes, in selected locations, tertiary contact strips for constituting parts of control circuits for components other than the motor.

25. A switch according to claim 23, for a motor vehicle having a cabin and an installation for delivering air into the cabin, the installation including an electric motor and a blower coupled to the motor, wherein the motor drives the blower and the switch controls the motor to control the speed of the blower, the installation operating in a first mode and a second mode, wherein, in the first mode, fresh air is drawn from outside the vehicle, and wherein, in the second mode air is drawn from the cabin, wherein a selection mechanism changes operation of the installation between the first and second modes and the switch is coupled to the selection mechanism.

26. A switch according to claim 25, wherein at least one of the primary contact strips is divided into two parts the two parts being connected electrically together, the two parts being arranged for connection to the selection mechanism for selection of the first mode and the second mode respectively.

27. A switch according to claim 1, wherein the primary and secondary contact strips in the set are distributed over an angular sector greater than 180°.

28. A switch according to claim 1, including a radial ring member having a pair of superimposed half rings, the projecting elements being radial extensions of the half rings, the member including means for securing the member on the body.

* * * * *

UNITED STATES PATENT AND TRADEMARK OFFICE

CERTIFICATE OF CORRECTION

PATENT NO. : 5,969,307

DATED : October 19, 1999

INVENTOR(S) : Louis Jean Michel Lacroix, et al.

It is certified that error appears in the above-identified patent and that said Letters Patent is hereby corrected as shown below:

In claim 11, col. 11, line 45, please delete "same and" and insert therefor -- same as --.

In claim 14, col. 11, line 61, please delete "length the" and insert therefor -- length, the --.

Signed and Sealed this

Twenty-ninth Day of August, 2000

*Attest:*

*Attesting Officer*

Q. TODD DICKINSON

*Director of Patents and Trademarks*